US007682650B1

(12) United States Patent
Ajayi et al.

(10) Patent No.: US 7,682,650 B1
(45) Date of Patent: Mar. 23, 2010

(54) METHOD FOR PRODUCING FUNCTIONALLY GRADED NANOCRYSTALLINE LAYER ON METAL SURFACE

(75) Inventors: Oyelayo O. Ajayi, Oswego, IL (US); Jeffrey G. Hershberger, Berwyn, IL (US)

(73) Assignee: Uchicago Argonne, LLC, Chicago, IL (US)

( * ) Notice: Subject to any disclaimer, the term of this patent is extended or adjusted under 35 U.S.C. 154(b) by 1346 days.

(21) Appl. No.: 10/841,731

(22) Filed: May 8, 2004

Related U.S. Application Data

(60) Provisional application No. 60/469,176, filed on May 9, 2003.

(51) Int. Cl.
*C23C 26/00* (2006.01)

(52) U.S. Cl. ..... 427/11; 427/177; 427/455; 451/41; 977/700

(58) Field of Classification Search ..... 427/11, 427/177, 455; 451/41
See application file for complete search history.

(56) References Cited

U.S. PATENT DOCUMENTS

| | | | | |
|---|---|---|---|---|
| 5,225,253 | A * | 7/1993 | Tung et al. | 427/566 |
| 5,513,512 | A * | 5/1996 | Segal | 72/253.1 |
| 7,211,323 | B2 * | 5/2007 | Erdemir et al. | 428/323 |
| 2003/0082311 | A1 * | 5/2003 | Kono et al. | 427/455 |
| 2003/0229399 | A1 * | 12/2003 | Namavar | 623/23.53 |

* cited by examiner

*Primary Examiner*—Shamim Ahmed
(74) *Attorney, Agent, or Firm*—Cherskov & Flaynik

(57) ABSTRACT

An improved process for the creation or formation of nanocrystalline layers on substrates' surfaces is provided. The process involves "prescuffing" the surface of a substrate such as a metal by allowing friction to occur on the surface by a load-bearing entity making rubbing contact and moving along and on the substrate's surface. The "prescuffing" action is terminated when the coefficient of friction between the surface and the noise is rising significantly. Often, the significant rise in the coefficient of friction is signaled by a change in pitch of the scuffing action sound emanating from the buffeted surface. The "prescuffing" gives rise to a harder and smoother surface which withstands better any inadequate lubrication that may take place when the "prescuffed" surface is contacted by other surfaces.

16 Claims, 8 Drawing Sheets

| | H (GPa) | H Hv | H RWC) | E (GPa) |
|---|---|---|---|---|
| First Layer | 13.1 | 1336 | 74 | 294.7 |
| Second layer | 9.0 | 918 | 67 | 232.2 |
| Third layer | 3.4 | 347 | 35 | 216.3 |
| Bulk | 3.5 | 367 | 36 | 235.8 |

METHOD FOR PRODUCING FUNCTIONALLY GRADED NANOCRYSTALLINE LAYER ON METAL SURFACE

This application claims the benefits of U.S. Provisional Patent Application No. 60/469,176, filed on May 9, 2003.

CONTRACTUAL ORIGIN OF THE INVENTION

The United States Government has rights in this invention pursuant to contract number W-31-109-ENG-38 between the U.S. Department of Energy and the University of Chicago representing Argonne National Laboratory.

BACKGROUND OF THE INVENTION

1. Field of the Invention

This invention relates to an improved method for prelubrication treatment of substrates' surfaces via the creation of nanophase layers on the surfaces, and more particularly, this invention relates to an improved method for preparing a functionally graded nanocrystalline layer on a metal surface to improve friction and wear performance, especially resistance to scuffing.

2. Background of the Invention

A problem extant in tribological science (the science of wear, friction, and lubrication) is a surface distress phenomenon commonly known as "scuffing." Scuffing is a severe adhesive failure situation associated with high speed, high load lubricated contacts. Lack of adequate lubrication may cause localized damage of the metal surfaces, often regarded as being micro-welding. Scuffing is particularly prevalent with cams, tappets, cylinder bores, and gears.

Scuffing often appears as a dull matte finish at the extreme end regions of the contact path. In addition to a line or path, scuffing can also affect an area. Generally, scuffing occurs when the sliding speed of a weight-bearing or loaded contact on a substrate surface exceeds a critical value known as the scuffing resistance.

Scuffing is characterized by direct intermittent surface-to-surface contact through the lubricating oil film. This contact occurs either due to poor entrainment, localized surface roughness, or debris entrapment. The contact causes an increase in the friction and, due to high loads and speeds, an increase in the frictional heating. The frictional heating gives rise to a decrease in the oil viscosity, with a corresponding decrease in the oil film thickness and, inevitably, a higher frequency of surface contact events. The increased contact causes even greater friction between the surfaces, more heating, even lower lubricant viscosity, and decreased separation between the surfaces. The number of surface contact events keeps increasing until the two surfaces suffer sudden, massive adhesive contact and seizure. This produces characteristic heat transformation layers at the surface.

One current method in the art to combat scuffing is nitriding or nitrocarburizing treatments. Another method is the use of low-friction coatings such as diamond-like carbon (DLC).

The scuffing problem and other tribological failures, such as abrasive wear, can be alleviated or even eliminated by reducing the grain size at and near the surface of substrates. Typical initial grain sizes in tribological components range from about 2 to 5 micrometers (μm) or microns (μ). Reducing the grain size of crystalline materials to nanometer (nm) size brings about significant changes in the properties of materials, e.g., increased hardness and yield strength to yield tribological or wear-resistant components. Nanophase or nanocrystalline materials are currently prepared by a plurality of techniques such as rapid solidification, rapid vapor condensation, ball milling, and the sol-gel process. All of the aforementioned processes are expensive for producing large quantities of materials. Further, in many situations, the nanocrystalline formation or property enhancement is needed only on the surface of a substrate.

U.S. Pat. Nos. 6,652,913; 6,620,498; and 6,472,060 awarded to Ruppi, et al. on Nov. 25, 2003, Sep. 16, 2003, and Oct. 29, 2002, respectively, disclose a method for depositing nanocrystalline coatings using chemical vapor deposition (CVD).

U.S. Pat. No. 5,309,874 awarded to Willermet, et al. on May 10, 1994 discloses a method for depositing nanocrystalline coatings using plasma-enhanced chemical vapor deposition (CVD) and sputtering.

None of the aforementioned patents provide for a simple method by which a nanocrystalline layer of more than a few microns thick can be created upon a substrate's surface. Further, none of these patents provide for the creation of the layer containing the same material as that found within the substrate. In addition, none of these patents provide for a mechanical method requiring a minimum of equipment.

A need exists in the art for a method by which nanocrystalline layers can be created by a direct mechanical means. A need also exists to eliminate the distinctive interface between coatings and the underlying substrate material. The method should be inexpensive and readily portable.

SUMMARY OF THE INVENTION

It is an object of the present invention to provide an improved method for prelubrication treatment of metals' surfaces that overcomes many of the disadvantages of the prior art.

Another object of the present invention is to provide an improved method for formation of a nanocrystalline layer of a substrate's material on the substrate's surface. A feature of the invention is that the substrate's surface is "prescuffed." An advantage of the invention is that it prevents sticking or "microwelding" between opposing substrates' surfaces that make frequent mechanical contact.

Still another object of the present invention is to provide a basic method for pretreating substrates' surfaces so as to provide resistance to scuffing. A feature of the invention is that the method involves plastically deforming the substrate's surface prior to putting the substrate into service. Another feature is that an adequate rise of coefficient of friction (indicating adequate deformation) is signalled with the emanation of an audio fingerprint. An advantage of the method is that the registration of the noise is an inexpensive notification to fabricators that additional surface scuffing should be terminated.

Yet another object of the present invention is to provide a quick and facile method for nanocrystalline formation. A feature of the invention is that nanocrystalline layers can be created, with simple physical contact and motion. An advantage of this feature is that it provides for a more rapid and efficient nanocrystalline layer formation process, and thus considerable time and cost savings.

Still another object of the present invention is to provide a much faster method for the creation of nanocrystalline layers on a substrate's surface. A feature of the invention is that the requisite layer can be created within 5 minutes. An advantage of this feature is that nanocrystalline layers can be produced at orders of magnitude higher rates.

Yet another object of the present invention is to provide a method that gives a more permanent surface treatment that can withstand scuffing and other tribological damage such as abrasive wear and contact fatigue. A feature of the invention is that a functionally graded nanocrystalline layer is created on the surface as opposed to a deposited film or layer. The nanocrystalline layer is created by reduction of the substrate's surface grain or crystal size. The nanocrystalline layer is an integral part of the treated substrate and thus does not have an interface with the substrate or a discontinuity. The grain size of the nanocrystalline layer increases gradually with greater depth into the substrate. An advantage is that the nanocrystalline layer is an integral and permanent part of the substrate and unlikely to peel or flake off.

Still another object is to provide a method which gives a highly reliable and durable tribological or wear-resistant interface. A feature of the invention is that it can be combined with thin-film coating technology. An advantage is that the wear resistance of tribological component surfaces is considerably enhanced.

Briefly the invention provides a process for creating a nanocrystalline layer on a metallic substrate, the process comprising subjecting the substrate's surface to controlled rubbing contact conditions that will produce severe plastic deformation to the surface.

The invention also provides a method for creating a scuff-resistant surface, the method comprising placing a load on the surface; using the load to exert pressure on the surface; moving the pressure-causing load over an area of the surface; allowing the pressure to cause severe plastic deformation as indicated by the onset of scuffing on the surface; and removing the load from the surface when scuffing begins.

BRIEF DESCRIPTION OF THE DRAWINGS

The invention together with the above and other objects and advantages will be best understood from the following detailed description of the preferred embodiment of the invention shown in the accompanying drawing, wherein.

DETAILED DESCRIPTION OF THE INVENTION

Figure 1:
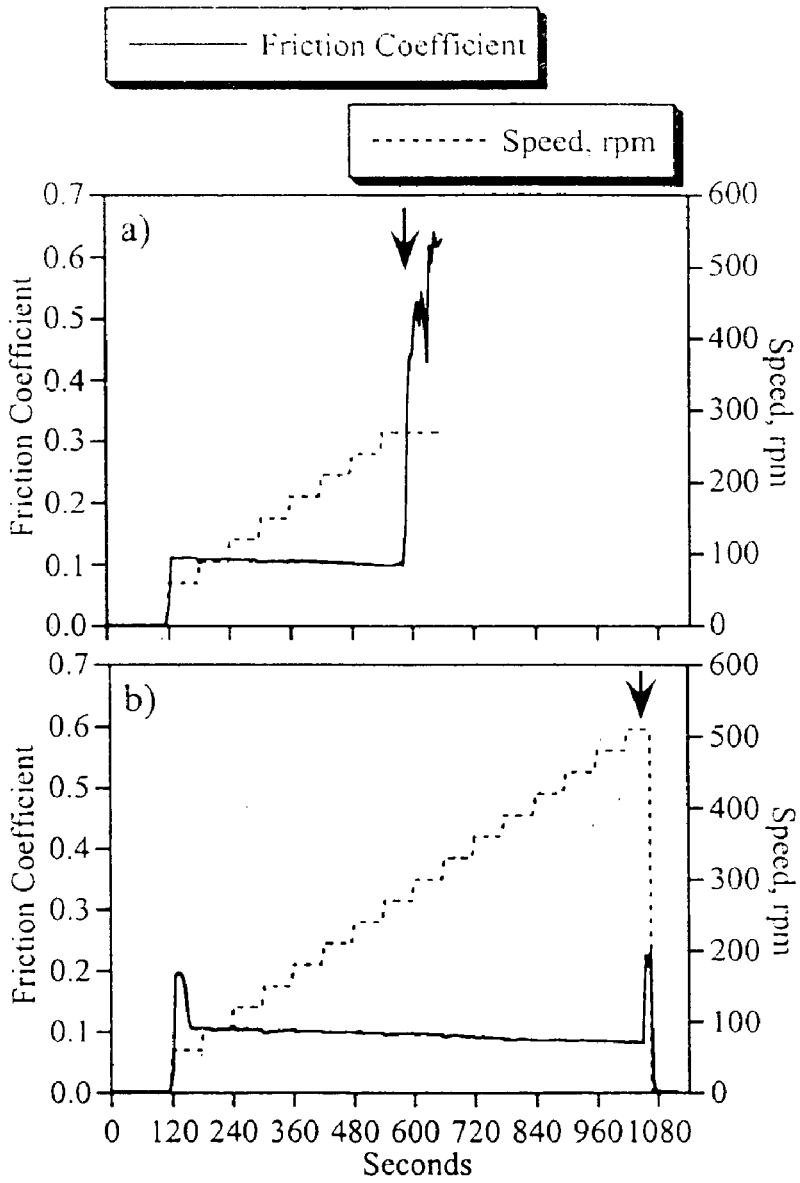
FIG. 1 is a plot of the coefficient of friction and sliding speed of a pressure-causing load on a substrate's surface as a function of time, in accordance with features of the present invention.

The inventors have found that improved lubricated surfaces can be achieved by subjecting a surface to controlled contact conditions. Generally, the method is applicable to surfaces which exhibit plastic deformation, such as metallic surfaces.

More specifically, the inventors have found that using a method for producing severe surface contact conditions such as localized high pressure, high friction, and high temperatures provides for the formation of a 20 μm thick functionally graded nanophase surface layer on a plurality of substrates, i.e., "prescuffing," via severe plastic deformation of the substrates' surfaces. Such severe plastic deformation occurs when the target surface is subjected to a shear strain greater than 5. The inventors have found that this shear strain value (which represents 500 percent of material plastic flow) is the minimal value to which a surface of the substrate should be subjected to arrive at the preferred nanoscaled particle sizes discussed infra. Essentially, when surface grains are subjected to the shear strain, dislocation motion and rearrangement results in the formation of smaller grains or nanophase material from those original surface grains. The resulting nanophase surface layer grain sizes increase as one goes deeper into the layers, thus providing a means for promotion functional grading of the layer.

The "prescuffing" action is terminated when the coefficient of friction between the surface and the load causing the localized high pressure is rising significantly. The "prescuffing" gives rise to a harder and smoother surface which better withstands the deleterious effects of any inadequate lubrication that may take place when the first surface is contacted by other surfaces.

In addition, the inventors have found that the hardness and elastic modulus of such a layer on a steel surface are comparable to the same properties of hard ceramic tribological coatings, i.e., a three-fold increase in hardness. (See FIG. 6 infra.) The instant invention is a simple and effective method to harden the surfaces of substrates such as steel.

A salient feature of the invention is that scuffing, normally a source of serious damage to contacting surfaces, is used to create this layer. The inventors have found that if the conditions causing the scuffing can be removed or eliminated immediately after the onset of scuffing, before roughening and damage occurs, a nanocrystalline layer is created on the surface of the substrate via what can be termed "prescuffing." The invention can be used at a site different from where the prescuffed materials are to used or, instead, the invention can be used in situ. Nanocrystal grain sizes created by the instant invention range from about 20 nanometers (nm) to 40 nm with a preferred size being 30 nm.

Metals and alloys are usually crystalline with grain or crystal sizes from about 1 to 10 μm. This invention reduces the grain or crystal size to the order of nanometers.

Other rubbing or sliding contact conditions can also produce a nanocrystalline layer, if such sliding results in severe plastic deformation. For metallic materials, any rubbing or sliding contact condition can facilitate grain sliding if the rate of thermal softening exceeds the rate of work hardening caused by the sliding contact.

When the invented method is applied to low-alloy steel, the inventors have also found that a significant amount of austenite is present in the surface of steel substrates after "prescuffing." Surface temperatures caused by "prescuffing" may exceed the temperatures required for rapid austenitization of steel. As such, the inventors have found that prescuffing temperatures also serves as a means for promoting austenization in some substrates. Austenitization is an indication of the contact temperature achieved. (In steel, austenite can also transform to martensite during subsequent service.).

Austenitization can be described as a phase transition process in which the dominant alpha-iron (α-Fe) phase (a body-centered cubic (bcc) structure) is changed into the face-centered cubic (fcc) structure of gamma-iron (γ-Fe). Heating and/or prescuffing/scuffing causes a solid-solid phase transition of steel.

The controlled contact is carried out at loads of from about 10 pounds (lbs.) to 1000 lbs. and at coefficients of friction of from about 0.1 to 1.0. The actual load used and the effective pressure depends on the nature and sample size of the material being scuffed. The controlled contact comprises sliding the pressure-causing load on the surface over a period of time and controlling the sliding speed.

The process can be carried out at ambient temperatures and requires from about 2 to 5 minutes. The actual surface temperatures of low-alloy (e.g., 4340) steel can rise to between 700° C. and 900° C.

Scuffing can be used in substrates other than low alloy steel, such as the wide variety of metallic alloys available. For example, alloys containing metals from Groups IVB, IVB, VB, VIB, VIIB, VIII, IB, IIB, and IIIA of the Periodic Table are suitable substrate genus candidates. Suitable species include alloys containing titanium, or aluminum, or copper, or chromium or vanadium. Generally, most metals which deform plastically are suitable scuffing candidates, that is to say, those metals whose atoms experience dislocation motion. Most metals that can deform plastically by rapid dislocation motion of layers of atoms can be scuffed. For normal rubbing contact without scuffing (i.e. dislocation motion), the contact temperature on a substrate's surface is usually less than 200° C.

The following examples are only to illustrate how to create a nanocrystalline layer on a substrate. Thus, the examples serve to illuminate the general process of the instant invention.

SCUFFING EXAMPLES

Tests were carried out on samples using the standard block-on-ring method and a Falex block-on-ring test rig (Sugar Grove, Ill.) with pure synthetic polyalphaolefin base stock oil [kinematic viscosity, 18 centistokes (cSt) at 40° C.]. Standard ring and block samples were fabricated from SAE 4340 steel of the nominal composition: 0.38 to 0.43 wt. % carbon (C); 0.8 wt. % chromium (Cr); 1.8 wt. % nickel (Ni); 0.25 wt. % molybdenum (Mo); and the remainder, iron (Fe). The samples were heat-hardened by austenitizing at 850° C. (~1560° F.) [>1500° F., the critical temperature for heating tool steel into austenite] for ~1 hour, with subsequent quenching. The quenching was followed by tempering of the samples for one hour at a temperature lower than the austenizing temperature.

Austenite, an intermediate crystalline form of steel, is a nonmagnetic solid solution of ferric carbide or carbon in iron. Quenching or sudden temperature-lowering causes austenite to transform into martensite between 600° F. (~315° C.) and 200° F. (~93° C.). Martensite, a body-centered tetragonal lattice structure, is the desired form of tool steel due to its hardness which is greater than that of austenite. The quenching causes austenite to trap carbon atoms within its face-centered cubic lattice to distort the austenite lattice into the martensite structure. Tempering is done to relieve the residual stress associated with the austenite to martensite phase transformation. Tempering is the process of reheating hardened steel to a temperature below the euctectoid temperature for the purpose of decreasing the steel's hardness and increasing the fracture toughness. Tempering in other metals is effected in a similar manner.

The samples were grouped and tempered at five different temperatures, as listed in Table 1 infra. The hardness of the samples is also listed in Table 1. After heat treatment, all the test specimens were ground to a surface roughness, $R_a$, of 0.7 μm.

During each test, the severity of contact was increased using the "step load increase" protocol, where the load is increased step-wise with the load remaining constant for an interval of time between load increases. The loading step or increase was 8.9 newtons (N) [~2 pounds (lb.)] with an interval of one minute (min) between each 8.9 N increase.

Each test was terminated immediately upon the occurrence of any scuffing. The timing required to stop the test precisely during scuffing was determined by a change in the sound pitch made by the test apparatus. (The load-surface contact always causes considerable sound.). The onset of scuffing is indicated by a sudden, large increase in the friction coefficient from about 0.1 to greater than 0.5. Scuffing is also indicated by increases in the overall bulk temperature of more than approximately 200° C. As mentioned supra, a change in the pitch of noise, and an increase in noise levels while the scuffing device contacts the surface also indicates the onset of scuffing. All these are indications of severe plastic deformation at the contact surface and the formation of a nanophase layer on the substrate surface.

FIG. 1 displays a plot of friction coefficient (solid lines) and sliding speed (dashed lines) as a function of time in two scuffing tests on a steel sample. Scuffing occurs when the sliding speed of a loaded contact exceeds a critical value called the scuffing resistance. Further, FIG. 1 displays, in part (a), "prescuffing," and, in part (b) the effects of that "prescuffing." In FIG. 1 (*a*), the polished sample was prescuffed. Using the Falex test rig mentioned supra, scuffing occurred at 270 revolutions per minute (rpm) as indicated by the arrow in part (a) of the figure. In FIG. 1 (*b*), scuffing on the prescuffed area of the sample occurred at 510 rpm as indicated by the arrow therein. The speed required for the onset of scuffing increased by 89%, and thus represents an improvement in scuffing resistance of the prescuffed surface of 89%.

TABLE 1

Tempering temperatures and Rockwell C hardnesses for samples of Group 1 through Group 5[a]

| Sample | Tempering Temp., ° C. | Hardness, $R_c$ |
|---|---|---|
| Group 1 | 204 | 53 |
| Group 2 | 260 | 50 |
| Group 3 | 316 | 46 |
| Group 4 | 540 | 39 |
| Group 5 | 650 | 29 |

[a]Lower tempering temperatures give the harder martensite as noted supra.

Generally, the higher the tempering temperature of the metal, the greater the load needed to scuff the metal.

Figure 2:
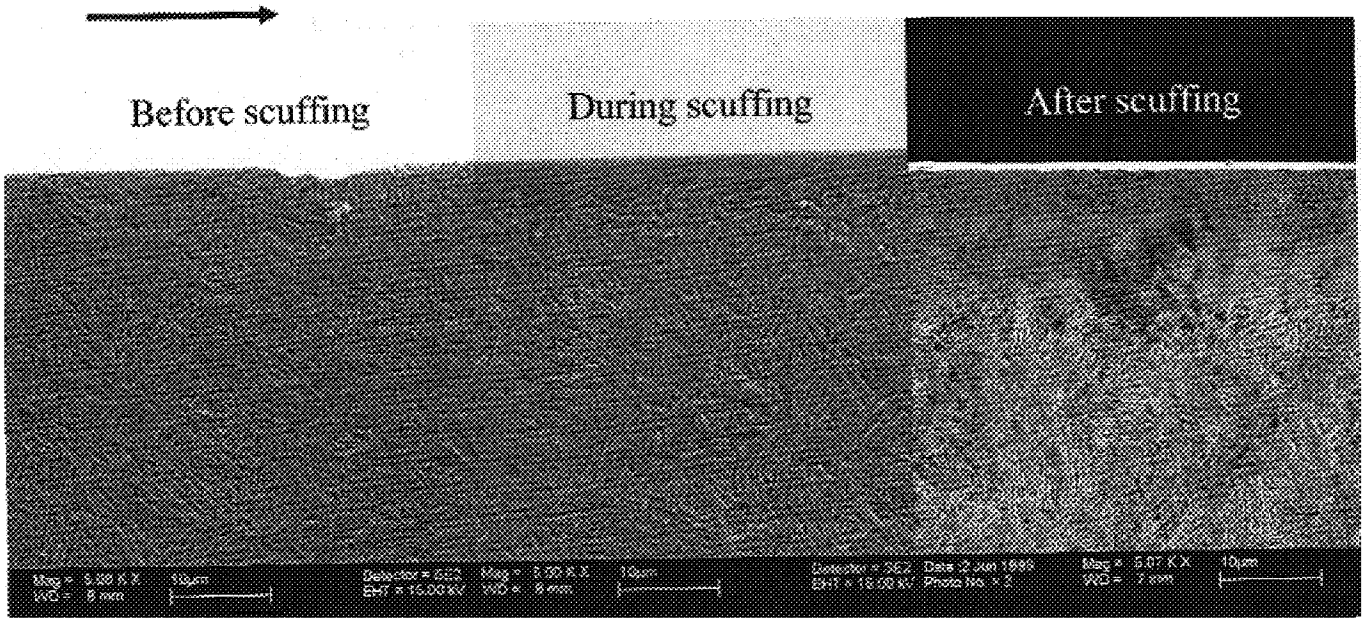
FIG. 2 is a schematic diagram of a scanning electron microscope (SEM) photo micrograph of polished and etched cross sections of substrates, in accordance with features of the present invention.

FIG. 2 depicts SEM micrographs of polished and etched cross sections of Group 2 samples. The images are from tests which were stopped (a) before, (b) during, and (c) after scuffing. Image (c) displays the formation of a nanocrystalline surface layer.

Figure 3:
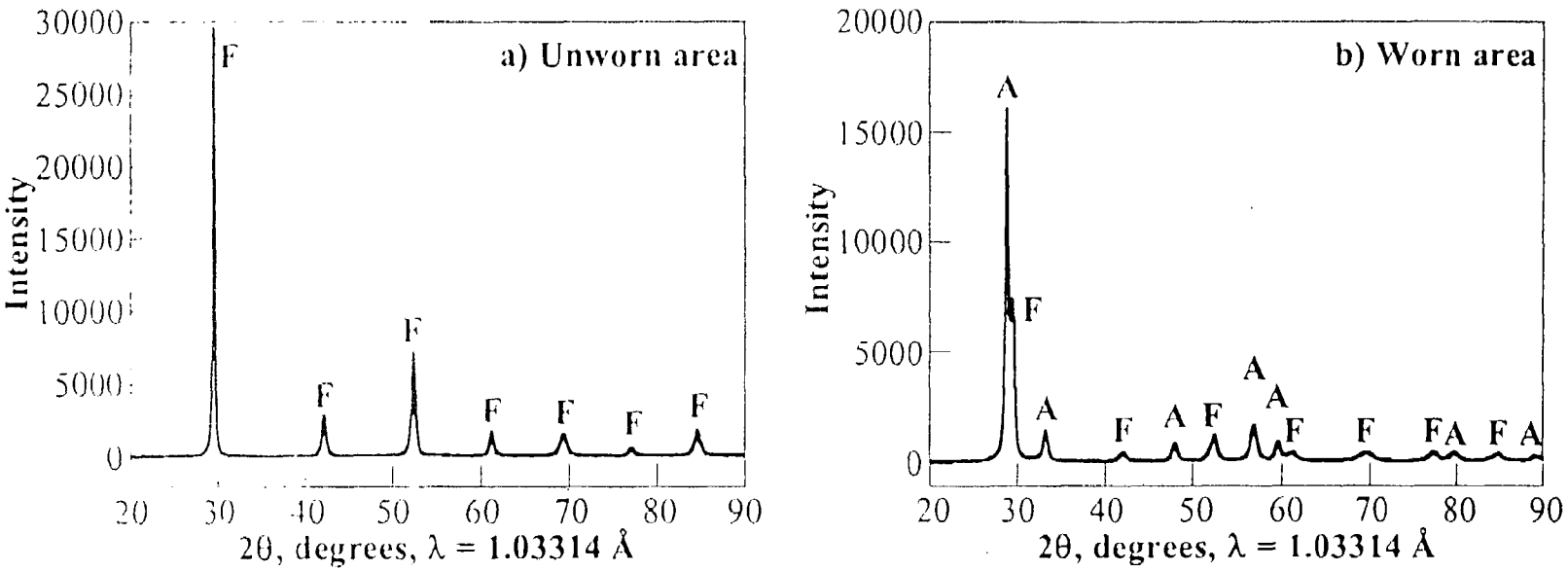
FIG. 3 is a schematic diagram of x-ray diffraction scans of a substrate before and after "prescuffing," in accordance with features of the present invention.

FIG. 3 depicts x-ray diffraction scans. These data were collected in grazing incidence mode with a wavelength, λ,=1.03314 Å or 0.103314 nm, using a penetration depth into the substrate of 1.2 μm. The scans show data from the noncontacted (a) and worn (b) areas of a Group 2 sample. The wear test was not interrupted until after scuffing had taken place. Peaks indexed as belonging to the ferrite phase are labeled "F," whereas austenite peaks are labeled "A." After scuffing, the surface has distinct signs of austenite as opposed to the unwear x-ray which displays only ferrite peaks.

Figure 4:
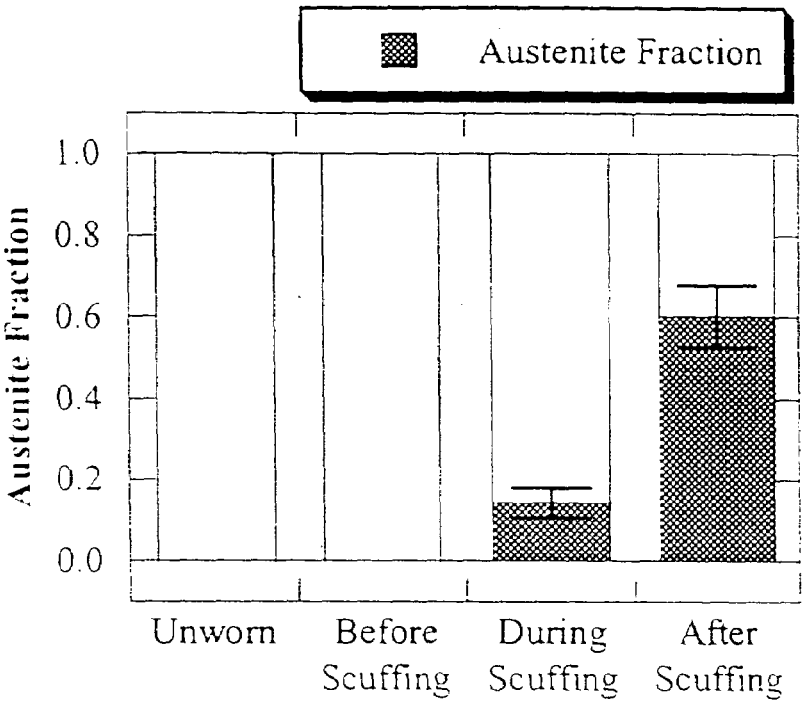
FIG. 4 is a plot of austenite fraction as a function of the stage of "prescuffing," in accordance with features of the present invention.

FIG. 4 depicts peak area or intensity analysis results for Group 2 samples during and after scuffing. The penetration depth was 1.2 μm. The cross-hatched areas represent the austenite fraction. The remainder of the material was ferrite. The vertical bars are error bars. The first two portions depict the amounts, or lack of, austenite before any wear occurs on the samples' surfaces, and also once a wear scar has formed on the surfaces, but before any scuffing occurs. The two other portions depict the volume percentage (v %) of austenite present during and after scuffing. Approximately 15% of the volume of the top 1.2 μm of the samples was austenite in the samples interrupted during scuffing, while the fully scuffed samples were found to be 60 v % austenite.

Figure 5:
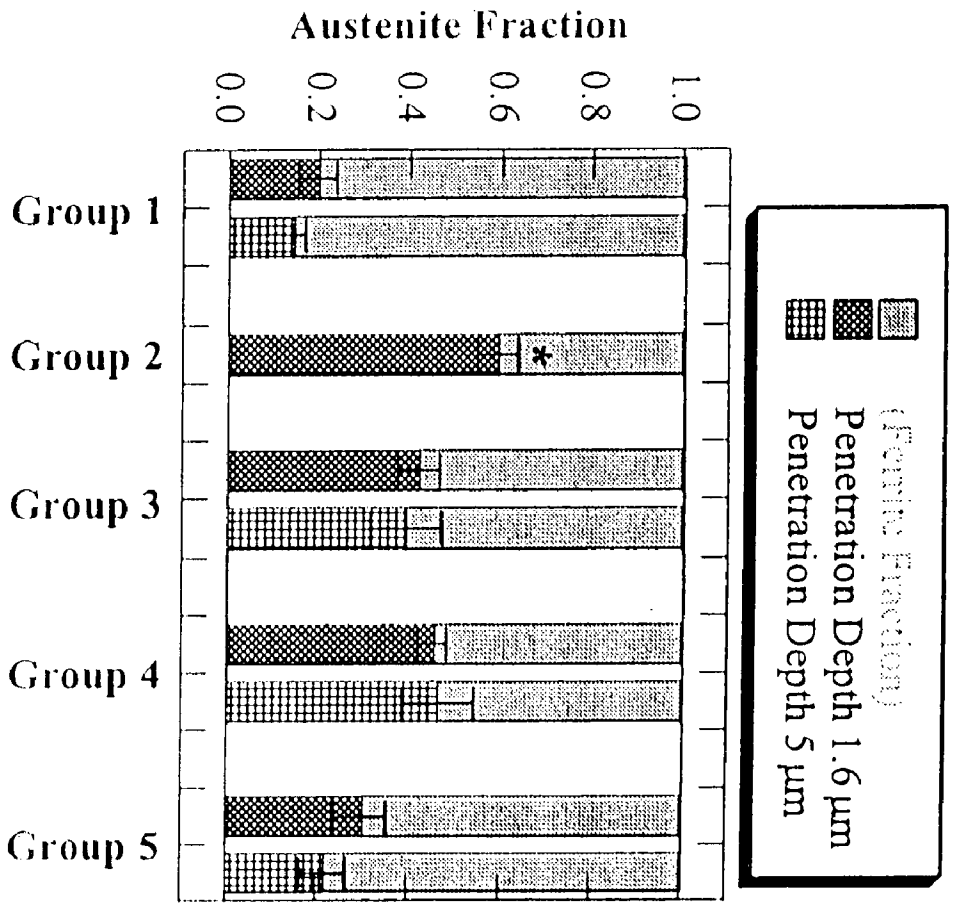
FIG. 5 is a plot of austenite fraction of different substrates as a function of the depth of penetration of x-rays into the substrates, in accordance with features of the present invention.

FIG. 5 depicts austenite and ferrite fractions present in samples of all five groups after the samples were rubbed to an after-scuffing condition. Solid gray gives the volume fraction of ferrite. For austenite, x-ray results for a penetration depth of 1.6 μm are given with a diagonal pattern (*except Group 2 where the x-ray penetration depth was 1.2 μm), and for penetration depths of 5 μm with a horizontal pattern. The results indicate that the austenite volume fractions were not very different for the two penetrations depths for samples of Groups 3 and 4. Further, the austenite fractions for Groups 1 and 5 were not much less than those for Groups 3 and 4. Some decrease in the austenite volume fraction at the 5 μm depth for Groups 1 and 5 may indicate that the layer containing austenite was thinner than 5 μm in those samples. As with FIG. 4, the vertical bars are error bars.

Figure 6:
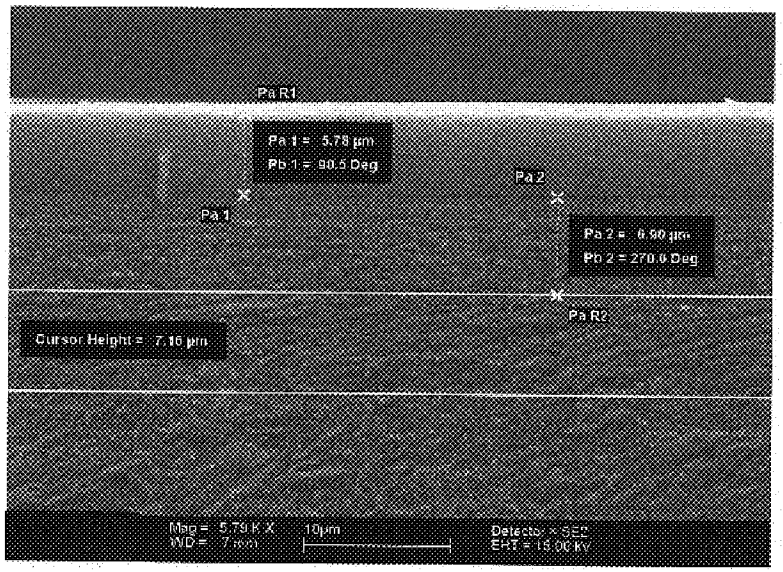
FIG. 6 is composite diagram depicting a SEM photo micrograph of a cross-section of steel subjected to the invented method, and a table of the hardness and elastic moduli of the corresponding regions of the cross section.

FIG. 6 depicts a cross section of a functionally graded surface layer on 4340 steel. On the right-hand side of FIG. 6 is a table giving the hardness (H), and the elastic moduli (E) for the corresponding three different layers in the functionally graded surface. Similarly, H and E is provided for the bulk material depicted as the bottom-most stratum in the photomicrograph. The hardness has three subcolumns, each using a different scale, the first being hardness in GigaPascals (GPa), the second column in the Vickers scale, and the third using the Rockwell C scale.

Using the GPa scale, the hardness and elastic modulus of the first layer (I.e., the outermost layer having direct exposure to the ambient environment) are about 45 percent and 27 percent greater, respectively, than the equivalent hardness and elastic modulus of the second layer. Similarly, the hardness and elastic modulus of the second layer are about 165 percent and seven percent greater, respectively, than the hardness and modulus of the third layer. The third layer's H and E are similar to those of the bulk material. Finally, the hardness and elastic moduli of the first (nanocrystalline) layer are about 274 percent and 25 percent greater, respectively, than the hardness and elastic modulus of the bulk material. The $Pa_1$ and $Pa_2$ in FIG. 6 are markers for measuring a layer's thickness. $Pa_1$ (5.78 μm) was measured from $PaR_1$ to $Pa_1$. Similarly, $Pa_2$ (6.90 μm) was measured from $PaR_2$ to $Pa_2$. $Pb_1$ and $Pb_2$ indicate the angle of rotation of the cursor.

The layers generated by scuffing are continuous such that subsequent layers substantially cover the immediate underlying layer (e.g., the "First Layer" in FIG. 6 completely covers the Second Layer).

Figure 7:
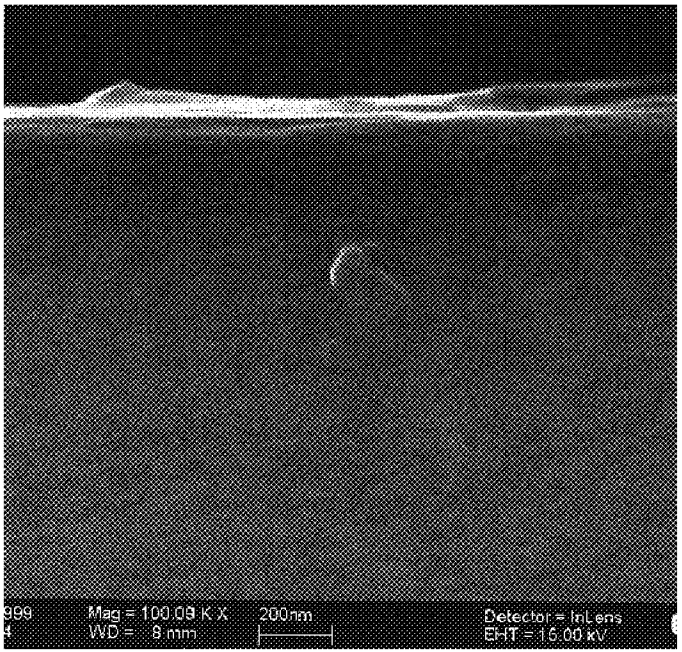
FIG. 7 is a schematic diagram of a high magnification SEM photo micrograph of a nanophase surface layer with a 30 nm grain size on steel, in accordance with features of the invention.

FIG. 7 depicts a scanning electron microscope (SEM) photo micrograph at high magnification of the nanophase layer of the same 4340 steel (FIG. 6) showing an average grain size of about 30 nm.

Figure 8:
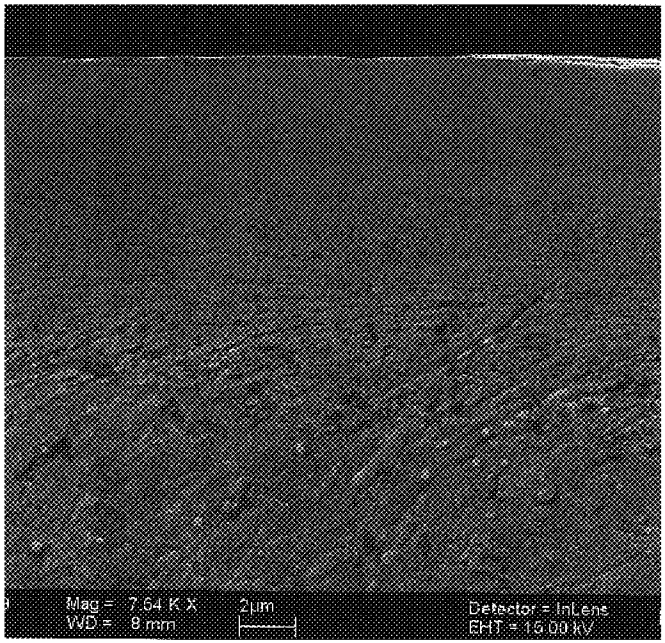
FIG. 8 is a schematic diagram of a SEM photo micrograph of the functionally graded nanophase surface layer produced on low-alloy steel, in accordance with features of the invention.

FIG. 8 depicts a scanning electron microscope (SEM) photo micrograph of the functionally graded nanophase surface layer produced on 4340 low-alloy steel.

The instant invention creates surfaces on substrates which are smoother and resist scuffing more readily. Further, the surface can be created by rubbing a pressure-causing load on the desired surface.

There are no physical limitations on the types of substrates upon which prescuffing can be carried out. Any size or shape of substrate can be treated with the instant invention.

The instant invention can be used to overcome the "microweld" problem, i.e., sticking together of substrates' surfaces, described supra. Controlled creation of nanocrystalline layers of the substrate can facilitate the effectiveness of lubrication of substrate surfaces. Even a very thin film of a lubricant can be more effective with a surface that has been "prescuffed."

The thickness of a typical nanocrystalline layer created by prescuffing of steels is about 20 μm. Layer thicknesses of between 15 μm and 25 μm occur with this method.

The nanocrystalline layer is a function of grain size which becomes larger with greater depth into the substrate. The layer is an integral, permanent part of the substrate (i.e., integrally molded with) and thus lacks any interface or discontinuity with the substrate.

Nanocrystal grain sizes created by the instant invention range from about 20 nanometers (nm) to 40 nm with a preferred size being 30 nm.

The thicknesses of nanocrystalline layers can vary according to the substrate and the conditions under which it was created.

Scuffing or "prescuffing" promotes the partial transformation of the ferrite surface of a steel substrate into austenite in low-alloy steel. However, phase transformation is not always necessary to facilitate the formation of a nanophase layer. As such, other materials, such as aluminum alloys, nickel alloys, and vanadium alloys that do not undergo a ferrite to austenite phase transformation can also be processed by this method.

The instant invention provides a method which gives a highly reliable and durable tribological or wear-resistant interface. The method can be combined with thin-film coating technology to considerably enhance the wear resistance of tribological component surfaces.

The invention can be used at a site different from where the prescuffed materials are to used or, instead, the invention can be used in situ.

A combination of process variables must be carefully controlled to obtain optimized conditions. Key process variables include the mechanical properties of the material, temperature, sliding speed, pressure-creating load, and duration of prescuffing.

While the invention has been described with reference to details of the illustrated embodiments, these details are not intended to limit the scope of the invention as defined in the appended claims.

The invention claimed is:

1. A process for creating a graded nano crystalline layer on a surface of a metallic substrate, the process comprising subjecting the substrate's surface to controlled rubbing contact conditions until the crystalline layer has greater grain size with greater depth into the substrate, wherein the crystalline layer is created by reduction of the substrate's surface grain size with resulting grain sizes of from about 20 nanometers (nm) to 40 nanometers.

2. The process as recited in claim 1 wherein the controlled rubbing contact is localized and is carried out at loads of from about 10 to 1000 lbs.

3. The process as recited in claim 1 wherein the controlled rubbing contact is carried out at coefficients of friction of from about 0.1 to 1.0.

4. The process as recited in claim 1 wherein the controlled contact is carried out at ambient temperatures.

5. The process as recited in claim 1 wherein the process is carried out in from about 2 to 5 minutes.

6. The process as recited in claim 1 wherein the process causes a localized severe plastic deformation of the surface.

7. The process as recited in claim 1 wherein the controlled rubbing is terminated upon the emanation of an audio fingerprint from the surface.

8. A method for creating a graded scuff-resistant surface, the method comprising:

a) placing a load on the surface of a substrate;

b) using the load to exert rubbing contact pressure on a localized area of the surface;

c) moving the pressure-causing load over the area of the surface;

d) allowing the pressure to cause the onset of scuffing on the area of the surface; and e) removing the load from the surface when a crystalline layer develops on the area of the surface wherein the layer displays greater grain size with greater depth into the substrate wherein the grain size ranges from about 20 nanometers (nm) to 40 nanometers.

9. The method as recited in claim 8 wherein the method further comprises sliding the pressure-causing load on the surface over a period of time.

10. The method as recited in claim 8 wherein the movement of the pressure-causing load is a means for creating nanocrystalline layers on the surface.

11. The method as recited in claim 8 wherein the method is carried out at ambient temperature.

12. The method as recited in claim 8 wherein the load is removed when the friction coefficient of the surface suddenly increases from about 0.1 to greater than 0.5.

13. The method as recited in claim 8 wherein the speed of movement of the pressure-causing load is controlled.

14. The method as recited in claim 8 wherein the method creates a functionally graded crystalline layer, on the substrate's surface, which has greater grain size with greater depth into the substrate.

15. The method as recited in claim 8 wherein the method causes the surface of low-alloy steel to experience an increase in temperature to between 700° C. and 900° C.

16. The process as recited in claim 8 wherein the process causes a severe plastic deformation of the surface with a shear strain greater than 5.

* * * * *